US007698790B2

(12) United States Patent
Holloway et al.

(10) Patent No.: US 7,698,790 B2
(45) Date of Patent: Apr. 20, 2010

(54) STOP FOR SLIDE FASTENERS

(75) Inventors: William Stephen Holloway, Cochran, GA (US); Jimmy Lee Ezzell, Gray, GA (US); Makoto Takayama, Macon, GA (US)

(73) Assignee: YKK Corporation, Tokyo (JP)

( * ) Notice: Subject to any disclaimer, the term of this patent is extended or adjusted under 35 U.S.C. 154(b) by 490 days.

(21) Appl. No.: 11/675,480

(22) Filed: Feb. 15, 2007

(65) Prior Publication Data

US 2008/0196219 A1 Aug. 21, 2008

(51) Int. Cl.
*A44B 19/36* (2006.01)

(52) U.S. Cl. ..... 24/436

(58) Field of Classification Search ..... 24/433, 24/436

See application file for complete search history.

(56) References Cited

U.S. PATENT DOCUMENTS 2,217,571 A * 10/1940 Susskind ..... 24/436
2,553,230 A * 5/1951 Bashover ..... 24/386
2,988,796 A * 6/1961 Johns ..... 24/436
3,805,339 A 4/1974 Howell
3,905,073 A 9/1975 Fukuroi
3,959,858 A 6/1976 Fukuroi
4,023,241 A 5/1977 Kanzaka
4,045,845 A 9/1977 Kando
4,112,553 A * 9/1978 Weitzner ..... 24/436
4,137,608 A 2/1979 Moertel
4,571,785 A * 2/1986 Akashi ..... 24/433
7,036,192 B2 5/2006 Yoneoka

* cited by examiner

*Primary Examiner*—Robert J Sandy
(74) *Attorney, Agent, or Firm*—Greenberg Traurig, LLP

(57) ABSTRACT

A reusable slider stop member has a solid body shaped to fit over a tooth element in a slide fastener assembly. The solid body has a central through channel defined by a pair of parallel prongs which fit over a tooth element. Each prong has an internal shoulder that engages a portion of the tooth element to retain the stop in place. The stop may be removed without damaging the stop or the tooth element, thus permitting easy repair of slide fastener assembly components. The stop is installed by aligning the channel at a right angle to the axis of the array of tooth elements, pressing the stop partially onto the tooth element, twisting the stop into alignment with the array and pressing the stop fully onto the tooth element to engage the internal shoulder of the stop with the tooth element.

19 Claims, 6 Drawing Sheets

STOP FOR SLIDE FASTENERS

BACKGROUND

1. Technical Field

This disclosure relates to the installation and use of stops for slide fasteners, and particularly to such stops which are easily attached by hand to prevent the slider from being removed during or after installation of a slide fastener in an article such as a garment.

2. Background Art

The stop prevents the slider from being removed from the top of the slide fastener in the event the slide fastener is cut to a desired length. The present disclosure departs from conventional concepts and designs of the prior art, and in doing so provides a member which can be inserted by hand without the need of a special tool or time consuming procedure for securing the stop onto the slide fastener.

SUMMARY OF THE DISCLOSURE

The disclosure summarized is a stop for slide fasteners including a slider stop member and a channel for receiving at least one of the pair of coupling means such as an injected molded element, the stop member having a set of parallel prongs and said parallel prongs containing corresponding parallel ledges along the inner walls of the parallel prongs. The parallel prongs extend downward, for penetrating the engaging element of the slide fastener. The ledges inside of the parallel prongs grasp and lock the element to prevent the slider from coming off.

An object of the disclosure is to construct a stop which can be easily secured in position preventing removal of the slide fastener from the fastener.

Another object of the disclosure is to construct a re-usable stop which can be easily secured and thereafter removed from a slide fastener.

An additional object of the disclosure is to construct a stop which can be secured upon the slide fastener by finger pressure during or after the installation of the slide fastener in an article or garment.

An object of the disclosure is to construct a stop which can be removed by hand from a slide fastener, without the use of a tool or machine.

An additional object of the disclosure is to allow for the removal of the stop from the slide fastener, permitting the removal of the slider and the installation of a new slider and the reattachment of the stop.

A feature of the disclosure is that a new stop may be installed within an article or garment when a slide fastener is cut down to a certain length, thereby removing the original stop. The new stop can be installed by hand to prevent the slider from being removed.

An additional feature of the stop employs a laterally extending two clip locking projection inside the stop. The locking projection has gripping ledges extending inward for penetrating into a portion of the engaging element, which provides a means to secure the stop on the slide fastener.

An object of the disclosure contemplates the creation and use of a stop which can be created from materials which match the existing slide fastener in both aesthetic and physical characteristics.

Other objects, advantages and features of the disclosure will be apparent from the following disclosure of the preferred embodiment taken in conjunction with the accompanying drawings.

BRIEF DISCLOSURE OF THE DRAWINGS

The above-mentioned features and objects of the present disclosure will become more apparent with reference to the following description taken in conjunction with the accompanying drawings wherein like reference numerals denote like elements and in which.

DISCLOSURE OF THE PREFERRED EMBODIMENTS

Figure 1:
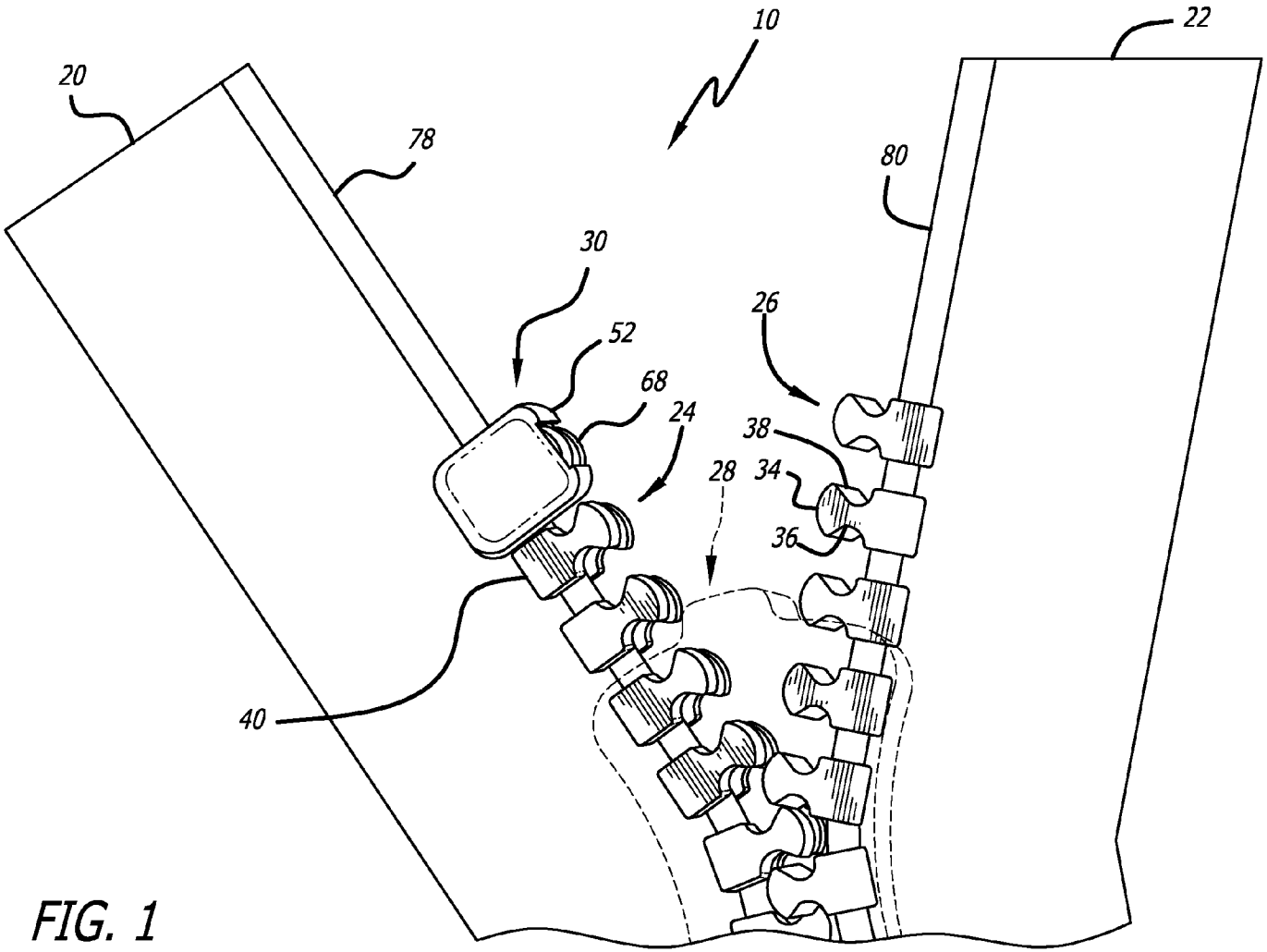
FIG. 1 is a front partial perspective view of a slide fastener assembly including a stop constructed in accordance with certain aspects of the disclosure.

FIG. 1 is a perspective front view of an assembled slide fastener assembly 10 that has a pair of flat tapes 20 and 22 with a linear set of tooth elements 24 and 26 secured along the inner edges of the respective tapes 20 and 22 on cords 78 and 80. The assembly 10 includes at least one stop 30 in accordance with the present disclosure fastened to one of the elements 24 or 26. The tapes 20 and 22 are designed to be sewn or otherwise fastened to a fabric (not shown). A slider 28 is mounted over the tooth elements 24 and 26. Linear motion of the slider 28 along the cords 78 and 80 opens and closes together the elements 24 and 26 in an alternating interlocking sequence as is illustrated in FIG. 1.

Figure 2:
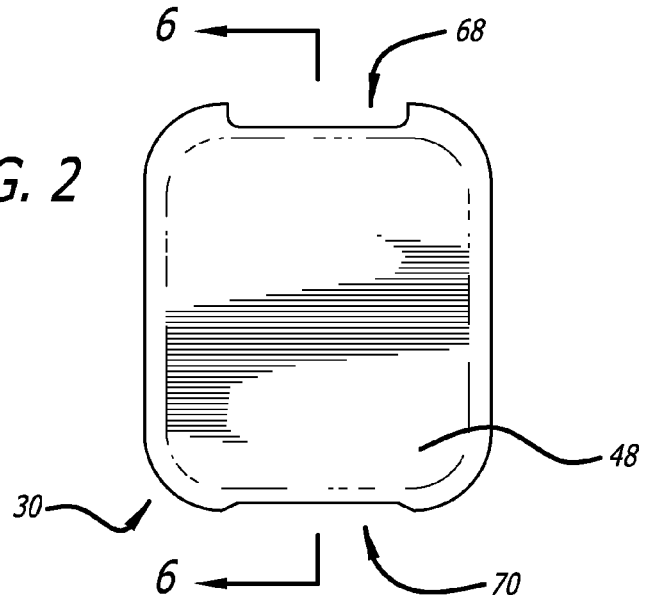
FIG. 2 is a separate enlarged front side view of a stop used in the slide fastener assembly according to the present disclosure.
Figure 3:
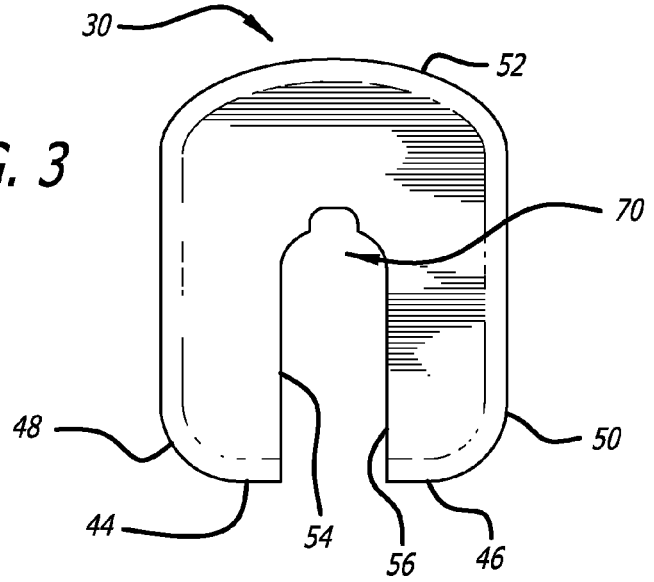
FIG. 3 is an end view of the stop shown in FIG. 2.
Figure 4:
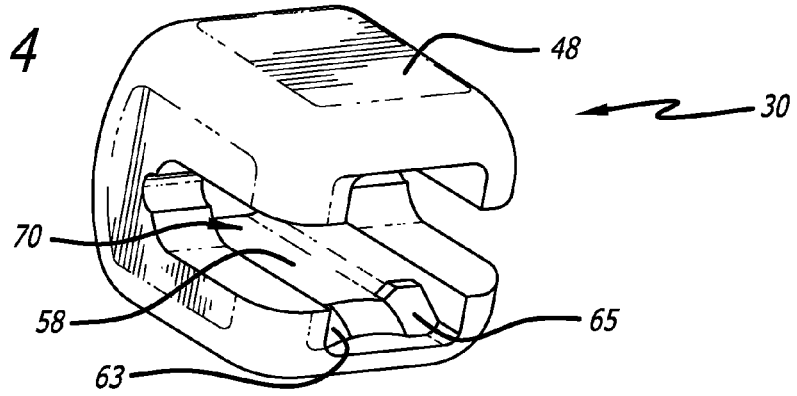
FIG. 4 is a bottom perspective view of the stop shown in FIGS. 2 and 3.

Separate perspective views of the stop 30 are shown in FIGS. 2 through 4. The stop 30 is comprised of a solid female shaped body that embraces and locks onto any one of the male shaped tooth elements 24 or 26 in the slide fastener assembly 10. The slide fastener assembly 10 is preferably made from a composition and by a suitably known process common within the industry. For example, slide fastener assembly 10 can contain a row of engaging teeth or tooth elements 24 and 26 disposed along the facing edges of a pair of fastener tapes 20 and 22, wherein a row of engaging teeth or elements 24 and 26 is made from a polyacetal resin or other material known within the industry.

The slide fastener assembly 10 may also include at one end a stop and at the other end a separable stop 30. The stop 30 is formed by conventional molding techniques from a thermoplastic resin or other suitable raw material common within the industry, which can be colored to match the slide fastener assembly components and has a length extending over one or more of the element 24 as viewed in FIG. 12, and more fully described below. Stop 30 can also be made UV resistant by the incorporation of common UV stabilizer additives within the raw materials.

FIG. 2 is a side perspective view of the stop 30 separated from the assembly 10. The stop 30 basically acts as a clip that attaches to one of the tooth elements of the assembly 10. The stop 30 is a generally rectangular solid body having a central channel therethrough extending from the front end through the back end as is shown in FIG. 3 so as to form a generally C shape when viewed as in FIG. 3. In the end view shown in FIG. 3, the stop 30 has spaced outer walls 48 and 50, joining common top wall 52 and together the walls form cantilever supported parallel prongs 44 and 46 defining the channel 70. Prongs 44 and 46 are rigid but elastically deflectable so as to frictionally separate when forced over one of the tooth elements 24 or 26.

The body of the stop 30 is hollow as viewed in FIG. 4. The stop 30 preferably has an opening or hole 68 through the top wall 52 is viewed in FIGS. 2 and 4. The opening 68 can be square, round, rectangular, oval, triangular or a shaped opening. The size of the opening 68 can vary. The stop 30 can contain opening 68 on the top wall or alternatively the top wall 52 can be solid as viewed in FIG. 3, depending on the strength characteristics of the particular plastic material used to form the stop 30 and the type of tooth elements the stop 30 is designed to accommodate.

Figure 5:
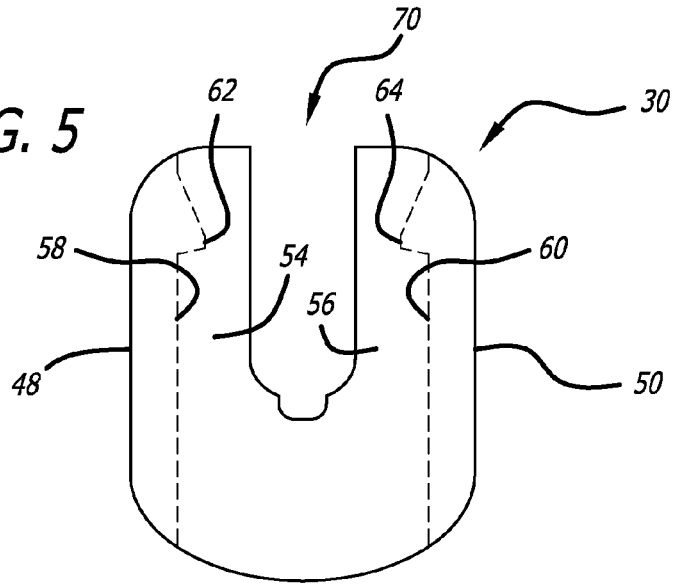
FIG. 5 is an inverted end view of the stop illustrated of FIG. 3.

The U-shaped channel 70 through the stop 30 is also shown in the inverted end view of FIG. 5. The channel 70 can be U-shaped, C-shaped, V-shaped, square, rectangular, or shaped to perfectly match the exterior shape of the tooth element 24 or 26 and cord 78 or 80 over and onto which the stop 30 is intended to be applied. The channel 70 may also include an indentation. FIG. 3 shows channel 70 being U-shaped with an indentation, divot or cutout in the wall at the top of the U-shape. The channel can have the divot at the top of the channel or the divot can be omitted, depending on the application. The channel is wide enough to allow the stop 30 to slide over the cord 78 and rest on the cord while the inner walls of the stop lock to the heel of the tooth element, as seen in the sectional view shown in FIG. 8.

Figure 12:
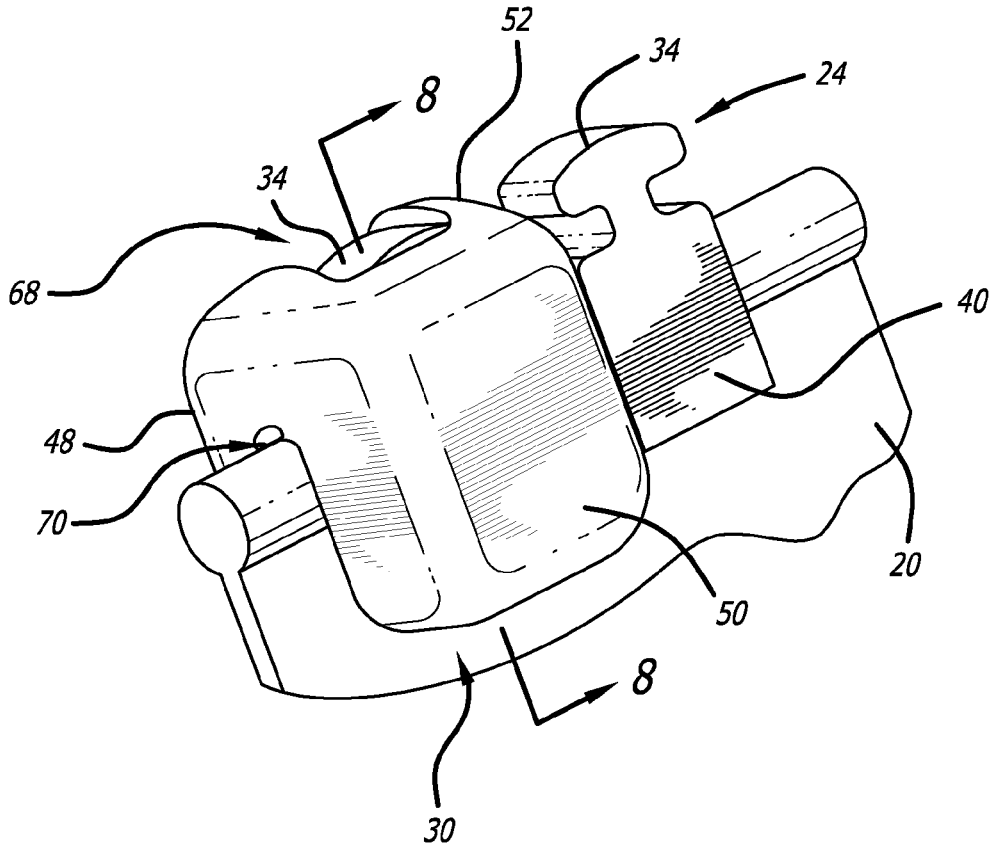
FIG. 12 is a front perspective view of the stop shown in FIGS. 9-11 in a fully engaged position on the tape element in accordance with the present disclosure.

The length and width of the channel 70 will vary depending upon the size and width of the tooth element 24 to which the stop 30 is intended to be installed on. The channel 70 is sized such that the stop 30 will fit snugly around the head 34 and heel 40 of the element 24, as is shown in FIG. 12. FIG. 3 shows inner parallel walls 54 and 56 of the body defining the channel 70.

Figure 6:
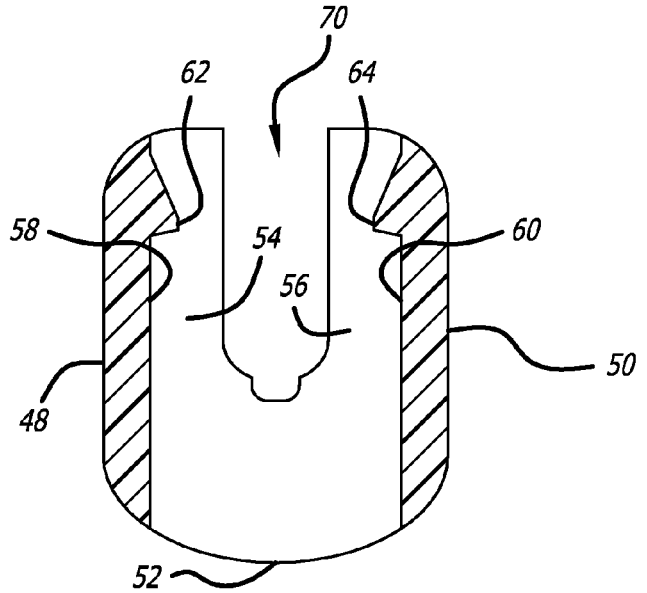
FIG. 6 is an enlarged cross section view of the stop taken along lines 6-6 in FIG. 2.
Figure 7:
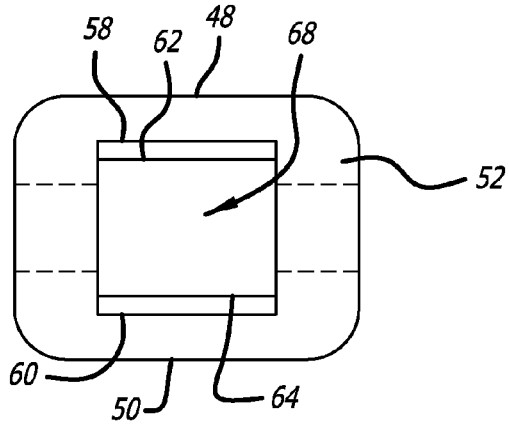
FIG. 7 is a top plan view of the stop shown in FIGS. 2-6.

Looking more closely at FIGS. 5 through 7, the stop 30, has two opposing recesses 58 and 60 within the walls 48 and 50. These recesses accommodate the full body width of the tooth element 24 or 26 over which the stop 30 is installed. Near the open end of the channel 70, the recesses terminate in opposing shoulder projections, ledges or hooks 62 and 64. These shoulder projections or ledges 62 and 64 hook over the heel 40 to clasp the heel 40 of the tooth element 24 or 26 to retain the stop 30 fully on the tooth element 24, as viewed in FIGS. 8 and 12. In order to install the stop 30, the stop must be pressed onto the tooth element 24 as described below such that the walls 48 and 50 resiliently deflect to receive the head 34 of the tooth 24.

Figure 8:
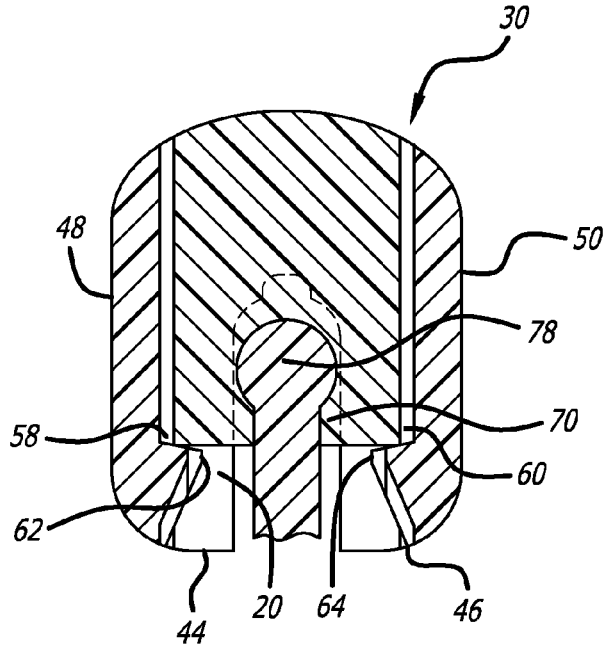
FIG. 8 is an enlarged cross sectional view of the stop installed on a tooth element in the slide fastener assembly shown in FIG. 12 taken along line 8-8.

Each of the prongs 48 and 50 has a tapered opening into the channel 70 forming shoulders 62 and 64 respectively projecting inwardly into the channel 70. The tapered opening forms guides or element shaped opening 63 and 65 as best seen in FIG. 4. This tapered opening is designed to accommodate the head 34 of the element 24 as the stop 30 is pressed onto the element 24 and cause the prongs 48 and 50 to elastically deflect to receive the head 34 during installation as more fully described below. The opposing projections 62 and 64 are positioned toward the open end of the channel 70 as shown in FIG. 8, so that they snap over and engage the heel 40 of the element 24. As an alternative, the parallel projections, locking keys, clips, lips, or hooks shoulders 62 and 64 can also be placed upward toward the middle of the channel 70 so as to clasp the head 34 of the element 24 (not shown). Further, prongs 48 and 50 may be configured with two sets of opposing shoulders or projections. One set being designed to clasp around the head 34 of the tooth element 24 or 26, while the second set clasps over the heel 40 of the tooth element 24 (not shown).

Figure 9:
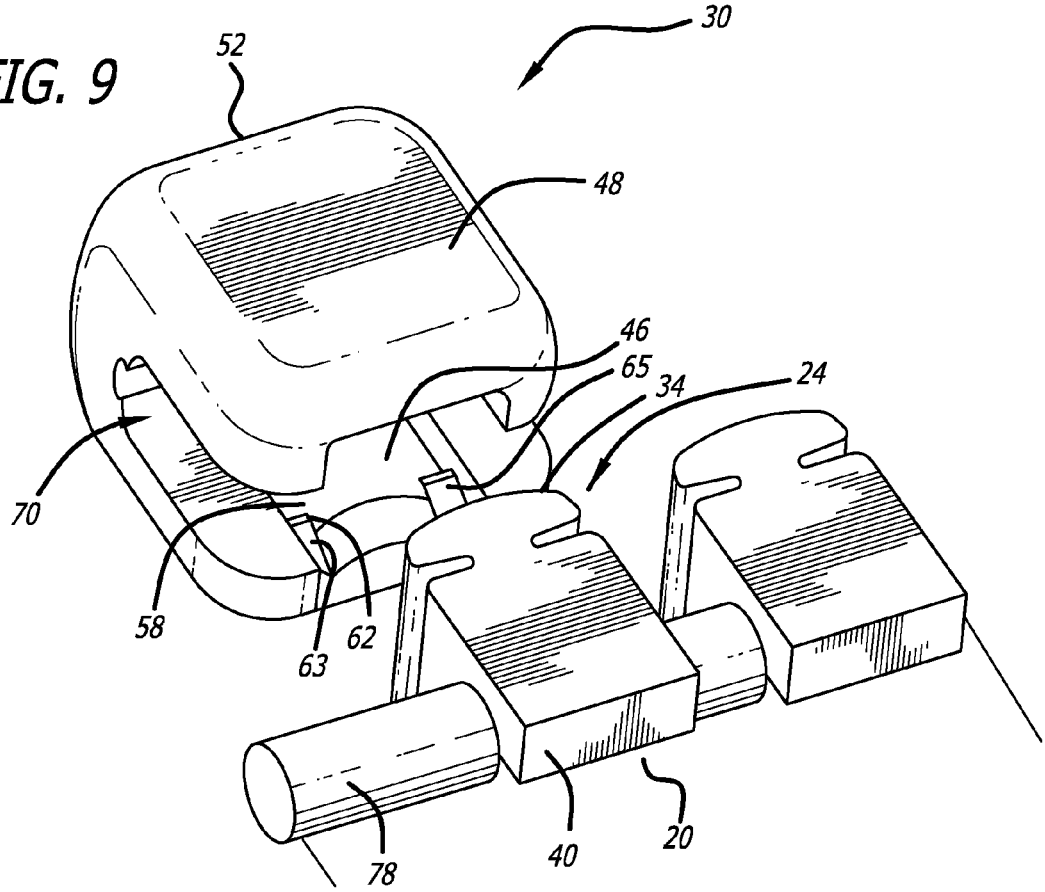
FIG. 9 is a separated perspective view of a stop positioned for installation adjacent a slide fastener tape element in accordance with aspects of the disclosure.
Figure 10:
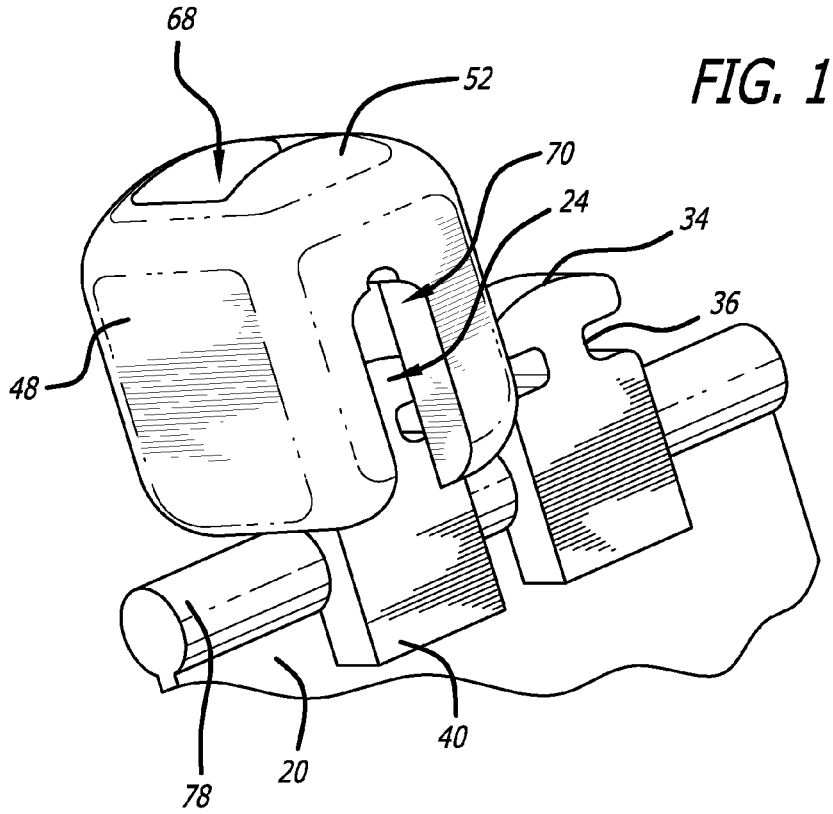
FIG. 10 is a perspective view of the slide stop shown in FIG. 9 in a first partially engaged position on the tape element according to aspects of the present disclosure.

FIGS. 9 through 12 illustrate the sequence of operation for installation of a stop 30 on a tooth element 24 in accordance with the present disclosure. FIG. 9 shows a stop 30 aligned for installation on a tooth element 24. The guides 63 and 65 in the opening of channel 70 self align the element 24 and ensure proper placement with channel 70. Prongs 44 and 46 engage with the element 24 to prevent removal of the stop 30 when placed on the slide fastener adjacent the tape 20. The prongs resist also lateral removal of the stop 30 as viewed in FIG. 12. A portion of the prongs 44 and 46 of the stop 30 is flexible.

Figure 11:
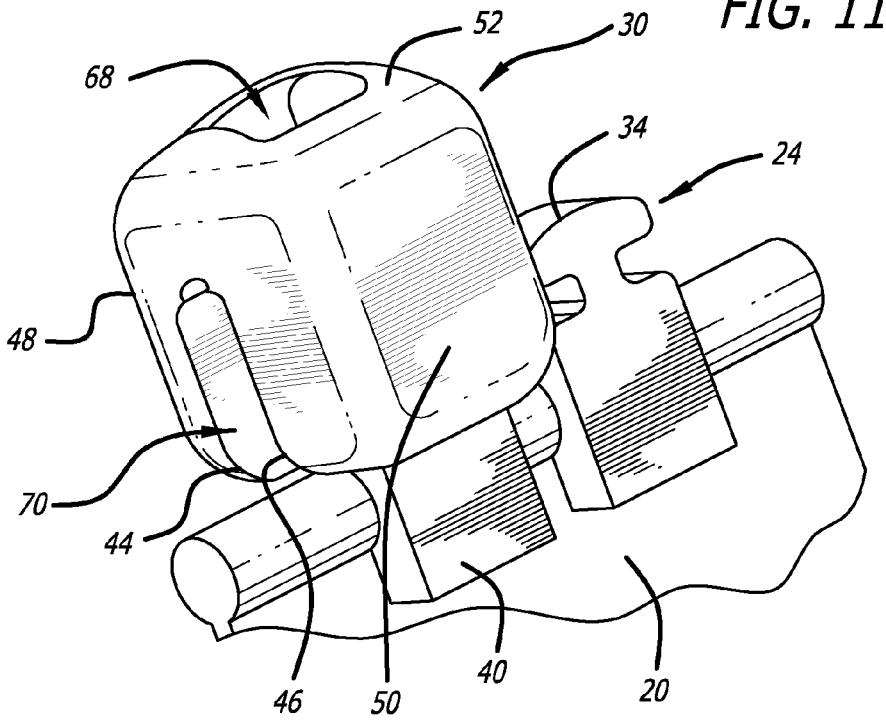
FIG. 11 is a perspective view of the stop shown in FIG. 9 in a second partially engaged position on the tape element in accordance with the present disclosure.

To install the stop 30 on the slide faster assembly 10, a stop 30 is first aligned with the axis of the channel 70 at a right angle to the axis of the linear array of tooth elements 24. The stop 30 is thus positioned over the element 24 as viewed in FIG. 10. The stop 30 is then pressed onto the head 34 of the element 24. The head 34 of the element 24 will slide up the glides or inclines 63 and 65, shown in of FIG. 9. The inclines or glides 63 and 65 of channel 70 will embrace the head 34 of the element 24 such that the head 34 is partially inserted in the channel 70. The head 34 will snap past the shoulders 62 and 64. Next, the stop 30 is twisted ninety degrees so as to align the axis of the channel 70 with the axis of the array of elements 24 and the chord 78 as shown in FIG. 11. Finally, pressure is again applied to the top wall 52 of the stop 30 and the stop 30 is pressed down over the heel 40 of the element 24 to the position shown in FIG. 12. In this position the shoulders 62 and 64 snap over and engage the heel 40 to retain the stop 30 fully over the tooth element 24.

Alternatively, the stop 30 can initially be positioned over the elements 24 by sliding the stop 30 over the open end of a slide fastener assembly, guiding the head 34 through guides 63 and 65, spreading the prongs 44 and 46 apart resiliently to position the stop 30 with the element 24 received within the channel 70 as viewed in FIG. 9. Then pressure is exerted on the top wall 52 by pressing with fingers, hands, or a tool causing surfaces 62 and 64 on the end of the prongs to engage the element 24 and to resiliently force the prongs 48 and 50 apart, thereby permitting the element 24 to move between the two prongs. Once the element 24 passes into the inside recesses 58 and 60 and past the shoulders 62 and 64, the prongs snap back capturing and securing the heel 40 of element 24 against the shoulders 62 and 64 as shown in FIG. 8. Thereafter the stop 30 is secured in position. This stop 30 operates in a conventional manner as other stops in the prior art to limit upward travel of the slider 28, as viewed in FIG. 12.

The stop 30 may be positioned and secured to the slide fastener after it is attached or sewn to an article such as a garment as viewed in FIG. 12. This permits accurate placement of the stops 30 as well as attachment of the slide fastener assembly 10 with the stops temporarily positioned away from the stitching or other attaching means.

The stop 30 may be removed from the slide fastener, by applying a spreading force to, or simply pressure against, the bottom of prongs 44 and 46, pushing the prongs upward toward the head of the element 24 as viewed in FIG. 11. Pressure can be applied with a person's hand, finger or a tool. The stop 30 will disengage from the shoulders 62 and 64 and the stop may be removed and then it can be reused again to secure the same or a different slider. Alternatively, the stop member 30 may be formed with movable interlocking outer walls which wrap around the element and lock together forming the stop described above.

While the stop has been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A stop for a slide fastener assembly comprising:

a solid body having a bottom wall and two adjacent outer side walls forming two parallel resilient prongs and defining a through channel therebetween;

said parallel prongs having parallel inner walls, and a top wall, the top wall having an opening therethrough;

said inner walls of the parallel prongs containing parallel inner ledges connected to the inside of the outer side walls of the stop;

said inner ledges containing lateral rearward abutment projections; and wherein when an engagement element is inserted into the channel, pressure is applied to the prongs to spread the prongs apart.

2. A stop as claimed in claim 1 wherein the stop is incorporated into a slide fastener comprising: a pair of flat tapes; a row of engaging elements disposed along the facing edges of a pair of flat tapes; wherein when the engaging element is inserted into the channel, the engaging element interlocks with the parallel inner ledges.

3. A stop as claimed in claim 2 wherein the parallel inner ledges have tops which are shaped as lateral rearward abutment projections.

4. A stop for a slide fastener assembly comprising:

a solid body having a bottom wall and two adjacent outer side walls forming two parallel resilient prongs and defining a through channel therebetween;

said parallel prongs having parallel inner walls;

said inner walls of the parallel prongs containing parallel inner ledges connected to the inside of the outer side walls of the stop;

the stop being incorporated into a slide fastener comprising: a pair of flat tapes; row of engaging elements disposed along the facing edges of a pair of flat tapes; wherein an engaging element is inserted into the channel and the engaging element interlocks with the parallel inner ledges;

said inner ledges containing lateral rearward abutment projections; and wherein one of the engaging elements engages the prongs spreading said prongs apart as the engaging element enters into the channel when pressure is applied to the top wall of the stop.

5. A stop in claim 4 wherein each prong includes a face includes a face inclined relative to an inside recess of the outer side walls and once the engaging element passes the lateral rearward abutment projections, the internal prongs snap back interlocking the engaging element behind the lateral rearward abutment projections.

6. A stop for a slide fastener comprising:

a clip member;

said clip member having two walls, a hollow cross section forming a longitudinal channel containing two internal prongs facing each other being mounted on opposite sides;

said internal prongs pointing up and out toward the opening of said longitudinal channel;

said internal prongs topped with a ledge and a top wall, the top wall having an opening therethrough; and wherein when an engagement element is inserted into a channel formed by the clip, pressure is applied to the prongs to spread the prongs apart.

7. A stop in claim 6 which is one piece, and wherein pressure is applied to a top wall of the clip.

8. A removable stop for a slide fastener assembly having a pair of tapes each tape having a linear array of tooth elements fastened along an edge of the tape, wherein each tooth element has a head portion and a heel portion, the heel portion being secured to the tape, the stop comprising:

a solid plastic body having a top wall and a pair of parallel prongs extending from the top wall and defining a through channel therebetween sized to receive the head portion of a tooth element therein;

each of the prongs having an internal ledge projecting into the channel and spaced from the top wall for capturing a portion of a tooth element placed within the channel between the ledge and the top wall, wherein the top wall has an opening therethrough; and wherein when the tooth element is inserted into the channel, pressure is applied to the prongs to spread the prongs apart.

9. The stop according to claim 8 wherein the prongs are elastically deflectable to accommodate a tooth element therein, and wherein the pressure is applied to a top wall of the stop.

10. The stop according to claim 9 wherein each of the prongs further comprises a tapered end portion terminating at the internal ledge for receiving a head portion of a tooth element therein.

11. The stop according to claim 9 wherein the prongs have an internal recess in the channel sized to accommodate the width of the head portion of a tooth element therein.

12. The stop according to claim 11 wherein the solid body is generally rectangular in shape.

13. The stop according to claim 8 wherein the solid body is generally rectangular in shape.

14. A method of installing a removable stop on one tooth element of a slide fastener assembly wherein the assembly includes a linear array of tooth elements fastened to an edge of a tape, the method comprising:

positioning a solid body stop having a pair of parallel prongs defining a through channel extending along an axis therethrough over a head of a tooth element;

aligning the stop with the axis of the channel at a right angle to the linear array of tooth elements;

pressing the stop onto a head portion of the tooth element so that the head portion enters the channel;

twisting the stop on the head portion of the tooth element so that the channel axis aligns with the linear array of tooth elements; and pressing the stop fully onto the tooth element.

15. The method according to claim 14 wherein the stop has at least one projecting ledge on at least one of the prongs and further comprising: pressing the stop onto the tooth element such that the projecting ledge engages a heel portion of the tooth element.

16. The method according to claim 15 wherein each prong has at least one projecting ledge engaging the heel portion of the tooth element when the stop is fully on the tooth element.

17. A slide fastener assembly comprising:

a pair of tapes each having a chord fastened along one edge of the tape;

a linear array of tooth elements fastened along the chord;

a slider positioned over the arrays of tooth elements operable to open and close the fastener by disengaging and engaging alternating tooth elements; and a removable stop fastened to one of the tooth elements to prevent the slider from being removed from the assembly, wherein the stop comprises:

a solid plastic body having a top wall with an opening therethrough, and a pair of parallel prongs extending from the top wall and defining a through channel therebetween receiving the head portion of a tooth element therein;

each of the prongs having an internal ledge projecting into the channel and spaced from the top wall capturing a portion of the tooth element within the channel between the ledge and the top wall; and wherein when a tooth element is inserted into the channel, pressure is applied to the prongs to spread the prongs apart.

18. The assembly according to claim 17 wherein each of the prongs further comprises a tapered end portion terminating at the internal ledge receiving the head portion of the tooth element therein.

19. The assembly according to claim 17 wherein the ledge engages a heel portion of the tooth to retain the entire tooth element within the stop body, and wherein the pressure is applied to a top wall of the assembly.

* * * * *